United States Patent [19]

Nachtrieb

[11] 4,390,331

[45] Jun. 28, 1983

[54] POSITIVE DISPLACEMENT FOUR LOBE IMPELLER STRUCTURE

[76] Inventor: Paul W. Nachtrieb, 6392 Park Ave., Garden Grove, Calif. 92645

[21] Appl. No.: 140,450

[22] Filed: Apr. 17, 1980

[51] Int. Cl.[3] ..... F04C 18/18; F04C 27/00

[52] U.S. Cl. ..... 418/141; 418/206

[58] Field of Search ..... 418/141, 206, 205

[56] References Cited

U.S. PATENT DOCUMENTS

| | | | |
|---|---|---|---|
| 12,350 | 2/1865 | Holly | 418/205 |
| 2,491,677 | 12/1949 | McCulloch | 418/206 |

FOREIGN PATENT DOCUMENTS

| | | | |
|---|---|---|---|
| 2394670 | 1/1979 | France | 418/206 |
| 10128 | of 1884 | United Kingdom | 418/206 |
| 1298198 | 11/1972 | United Kingdom | 418/206 |

*Primary Examiner*—John J. Vrablik

[57] ABSTRACT

A positive displacement four-lobe impeller structure for use as a fluid driving or a fluid driven member or pump or generator is presented. The terminology pump is used to describe said structure subsequently. The pump comprises a symmetrical cylindrical housing having two 190° arc cross-section interior walls separated by an inlet area and an outlet area. Inside the housing and disposed a selected distance apart therein are two cylindrical axially symmetric identical impellers. Each impeller comprises four interior concave arc sidewalls disposed 90° apart and forming the base of four lobes. The concave arc side walls flow into and couple to exterior convex arc sidewalls which in turn flow into and connect to dual slightly extended tips. Each of said tips is separated from the opposite tip on the end of the lobe by an arc tip indentation. Each impeller is coaxial with the 190° arc cross-section interior wall of the housing adjacent to it and has a radius very slightly less than the radius of the 190° arc, so that the tips of the impellers come very close to the interior side walls, but do not touch them. The housing is of sufficient size so that the impellers are placed just far enough apart so that the tips of each impeller fail by a small distance to touch the adjacent interior concave arc side wall of the opposing impeller during rotation.

3 Claims, 9 Drawing Figures

FIG. 1
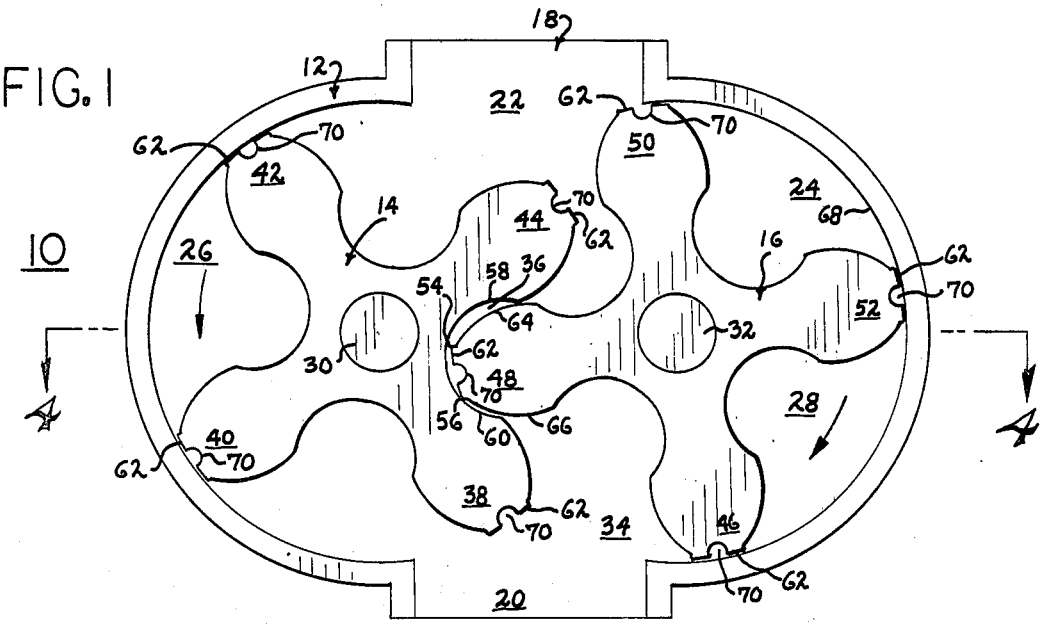
FIG. 2
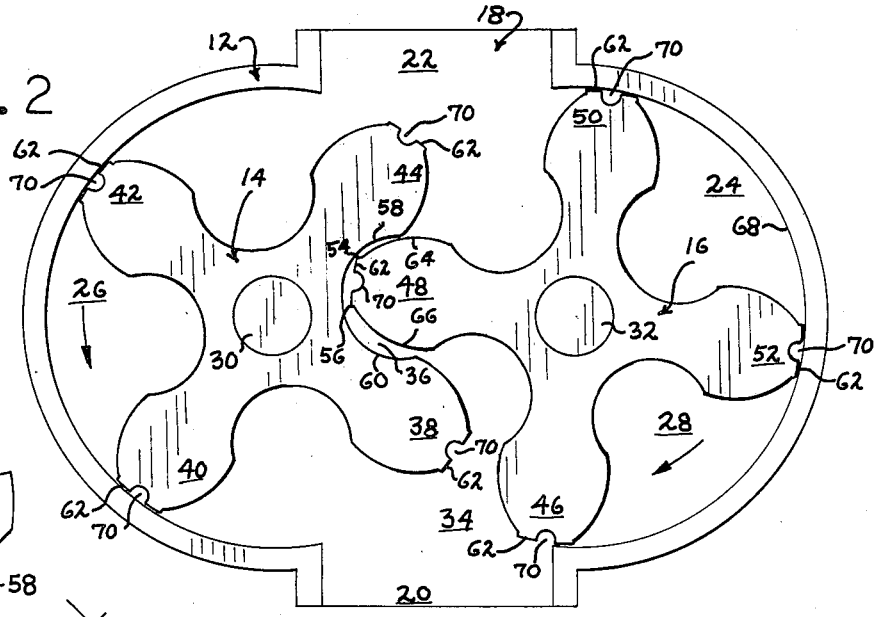
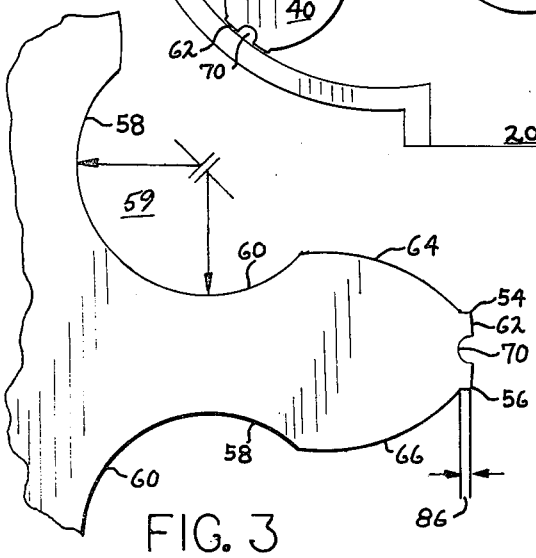
FIG. 3
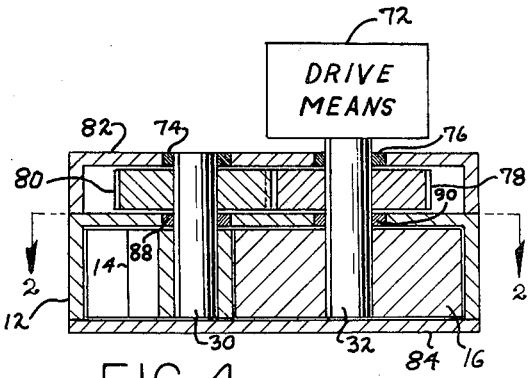
FIG. 4

POSITIVE DISPLACEMENT FOUR LOBE IMPELLER STRUCTURE

BACKGROUND OF THE INVENTION

1. Field of the Invention

The present invention comprises a positive-displacement pump having in the example described, four lobes. Such pumps may be used as pumps, motors, parts of generators, and a wide variety of uses known to the prior art.

2. Description of the Prior Art

The prior art includes many positive-displacement pumps, a substantial number of which comprise a matched pair of multilobed impellers housed in a pump chamber, including inlet and outlet ports located on opposite sides of the chamber. Typically, the impellers are affixed to parallel shafts which are in turn coupled to timing gears and drive means. In operation, the drive means rotate the impellers in opposite directions, somewhat out of phase, and the impellers form sealed compartments between their lobes and the adjacent interior pump chamber wall, thus substantially enclosing the fluid to be pumped and transporting it from the inlet to the outlet side of the pump chamber. Substantially all the fluid is prevented from being returned from the outlet side to the inlet side through the center of the meshing impellers because of the close proximity of the imposing parts and the precise clearance which is maintained by the timing gears which prevent contact between the counter-rotating impellers. In the past, many attempts have been made to design pump impellers for such pumps to overcome several shortcomings common to the generally accepted designs. Among these shortcomings are low volumetric efficiency, vibration, wear, etcetera. Volumetric efficiency may be defined as that part of the effective displacement of the pump which actually transports the fluid to be pumped. Any difference between the actual volume pumped and the effective pump displacement is regarded as a loss of pumping volumetric efficiency and a reduction of such loss is desirable. A further loss of pumping efficiency occurs due to internal pressures which develop during rotation of the impellers. Some of the fluid being transported slips back to the low pressure or inlet side of the pump chamber from the high pressure or outlet side of the pump chamber by flowing through and past whatever clearance exists between impeller tips and the adjacent pump chamber wall or the adjacent portion of the imposing impeller (between the two impellers). Other losses which reduce efficiency include friction caused by the drag of the fluid between walls and impellers, inertia of the moving parts, and diminished flow rate caused by fluid turbulence.

Rotary pumps designed for movement and compression of gases are commonly referred to in the trade as blowers, super chargers or compressors. The name usually indicates the application. Blowers and super chargers generally utilize two-lobed involute impellers which offer maximum displacement relative to pump chamber dimensions, thereby providing means of moving large volumes of gases at low pressures. Some blowers and super chargers use three-lobed impellers, especially where it is necessary to develop higher pressures and operate at higher velocities than is typical with two-lobed impellers. Compressors use two, three or even more lobes to comply with various specifications. Blowers and super chargers ordinarily operate dry and depend upon the close clearances between the moving parts to form pneumatic seals. Compressors often use wetting agents such as water or oil sprays to aid in maintaining effective pneumatic seals between moving parts. Generally the degree of compression or vacuum developed by such pumps is a function of effective sealing properties.

The present invention differs from the prior art in ways which increase operational efficiency, and useful life and lower the amount of energy required and fabrication costs for the following reasons, among others.

An impeller with four-lobed involute structure has several advantages over impellers with different numbers of lobes. Generally two-lobed involute impellers occupy 50 percent of the volume of pump chambers in which they operate, three-lobed impellers occupy 46 percent of the volume, but four-lobed involute impellers occupy only 41 percent of the volume of the pump chambers in which they operate. Accordingly, there is a substantial increase in effective displacement possible by using four-lobed involute impellers. Impellers having five or more involute lobes occupy more than 50 percent of the volume of pump chambers in which they operate because the lobes of such impellers must be shorter than the lobes of two, three or four-lobed impellers, thereby taking up a higher percentage of the volume inside the pump chamber. Multilobed impellers of the involute type may even approximate the appearance of actual involute gear teeth and because of their large bulk compared to the small space between lobes, they are impractical for use in pumping gases although they are often of value in pumping some other fluids.

Accordingly, four-lobed impeller pumps pump a greater volume per revolution through the pump chamber because of the increase in volumetric efficiency compared to the physical size of the interior of the pump chamber. There is also, of course, an increase in the volume pumped as compared to the mass of the impellers which results in higher horsepower efficiency, since more fluid is pumped compared to the power consumed in turning the non-contributing mass. The power loss in rotating impellers of greater weight such as two or three-lobed impellers cannot be offset by lightening the weight of such impellers by removing much of the bulk of the internal mass of such impellers because such action does not increase the effective displacement of the pumps using impellers of such construction.

Extensive testing has demonstrated that the most critical area of sealing is located where the impellers mesh with one another (where the tip of one impeller approaches the space between the tips of the adjoining impeller). Any excessive amount of clearance between the tips of the one impeller and the curved inner surface between the lobes of the opposite impeller results in a serious degree of fluid leakage back from the outlet to the inlet and greatly diminishes the pumps ability to compress gases, form a vacuum, or pump a fluid. This has been accomplished in the prior art by attempting to minimize the clearances. This problem is complicated because the shape of the cross-sectional area formed between the two impellers varies as a function of the rotation of the lobes and a corresponding orientation of the lobes and other surfaces of the two impellers. The problem is even more complicated, because not only does the volume change, but the change in volume has a tendency to change the internal pressures in the fluid and can be a source of severe vibration which can cause pump failure or inefficiency or wear, among other problems. Accordingly, external timing gears are frequently used in order to control the rotation freely and smoothly at high speeds. Such running gears must provide a minimum of backlash or running clearance between meshing teeth. However, in spite of adequate lubrication, after a period of rotation, such clearance will increase due to wear caused by sliding and rolling friction common to all meshing gears under load. In the prior art pumps, this causes the tracking corners of the impeller ends to strike the opposing impeller and thus cause noise and wear, deterioration of volumetric efficiency, decreased pressure and ultimate pump failure. The prior art discloses no designs which overcome this problem which prior to the present invention is almost seen to be inherent in the nature of a pump. The present invention, as will be explained later, includes an automatic clearance adjustment which does not affect the impeller's ability to accurately track and maintain proper clearance between its tips and the adjacent pump chamber walls. Because of this automatic clearance adjustment, a pump according to the present design will continue to function close to maximum efficiency in spite of normal gear wear. A pump according to the present invention does not require costly maintenance ordinarily expected of rotary lobed pumps of the prior art for correction, for wear caused by use.

Tests have shown that pumps pursuant to the present invention reduce the inefficiencies of prior art pumps by approximately 50 percent or more.

Additional advantages of four-lobed involute impellers compared to impellers of fewer lobes include a reduction in amplitude of pulsations caused by the release of compartments of fluid to the outlet chamber. Such pulsations are normally not of any consequence where the fluid pumped is a compressible gas, but they cause considerable vibration when liquids are pumped. Minimizing of these vibrations reduces excessive wear of gears and bearings caused by high amplitude pressure pulsations. The particular design of the present invention, particularly the way the tips mesh with the space between the lobes of the opposite impeller reduces such pulsations.

A further advantage of the present four-lobed design over two or three-lobed types is that a greater mass of the impellers is closer to the impeller center, resulting in a stronger structure and one requiring less energy to accelerate to operational velocities.

A four-lobed design is also superior for both gas and liquid pumps in its ability to develop and maintain adequate operational pressure. This inherent advantage is further improved by the present invention design since more points of near sealing are present to minimize the leakage of the fluid from the high pressure outlet side of a pump according to the present design to the low pressure inlet side, thereby resulting in a higher useful pressure being developed. The fact that with the present design, a greater part of the impeller mass is located closer to its center, the area of its lowest velocity, makes a structure according to the present invention inherently stronger and permits higher speed than possible with two or three-lobed designs otherwise structurally equivalent to the present invention.

Typically prior art pumps have problems with the depositing of materials from the fluid pumped such as dissolved salts, etcetera. A further advantage of the present invention is its self-cleaning capability since the leading sharp edges of the impeller tips continually and closely track the contours of the pump chamber walls in which they revolve, thereby effectively scraping off any deposits of solid which accumulate on such surfaces. Such scraping occurs on an incremental basis with extremely small amounts being scraped off during operation without any substantial loss of efficiency. In fact, the deposits normal to pumps utilizing fluid maintain the clearances of a pump according to the present design at or near the most efficient possible distances.

Pumps according to the present invention pump water with a volumetric efficiency of 90 percent at low head pressures and develop hydraulic horsepower efficiencies in excess of 85 percent. The same pump, used as a motor, can accelerate from a standing start to 3,000 RPM in two seconds with a driving fluid of air at 70° Farenheit and 2 psi. This appears to make a pump of the present design capable of doing work presently done by gas turbines with greater efficiency and a substantially smaller manufacturing cost and replacement and maintenance cost. Pumps according to the present design require approximately half the energy required by centrifugal pumps for equivalent fluid movement.

Like most other pumps, the present design benefits by expansion of capacity and it appears that since the preceding efficiencies were obtained by a pump of 18.75 cubic inch displacement, larger pumps may reach a hydraulic horsepower efficiency in excess of 95 percent.

Many prior art designs cannot operate with all fluids. The present invention can operate and pump all fluids which do not have characteristics inherently capable of destroying the structure of the pump (such as extremely high temperature which would melt the pump, etcetera).

Certain prior art pumps are self-priming. These prior art pumps lose their self-priming capabilities because the self-priming capability is inherently a function of physical contact within the pump chamber. A pump according to the present invention does not lose its self-priming capability because it does not lose tolerance after normal timing gear wear.

SUMMARY OF THE INVENTION

A self-priming positive displacement two impeller pump is presented. The pump comprises a symmetrical generally elliptical cross-section cylindrical housing having at opposite sides at least 180° arc cross-section interior walls. The walls are separated by a relatively low pressure fluid inlet space coupled to a fluid entrance on the inlet side and a relatively high pressure fluid outlet space coupled to a fluid exit on the opposite exit side. The two impellers are axially parallel counter-rotating synchronously rotated cylindrical, axially symmetric four lobe. Each impeller has a cross-section comprising four interior concave slightly elipsoid arc side walls disposed 90° apart and each elipsoid side wall forms half the base of two adjacent lobes of the four lobes. The interior arc lobe side wall connects at an inflexion line to exterior convex arc lobe side walls which in turn connect at an inflexion line to a convex arc cross-section tip having an arc radius equal to the impeller radius.

Each impeller is 45° out of rotational phase with the other impeller and each impeller is coaxial with the axis of the at least 180° arc cross-section adjoining interior wall. Each impeller has a radius incrementally less than the radius of the adjoining interior wall, such that adjacent lobes of each impeller during rotation define between themselves and the housing arc interior wall spaces which carry fluid from the fluid inlet area to the fluid outlet area. The impellers are selectively disposed apart such that the tips of each impeller fail by only an increment to touch the interior concave arc sidewall of the opposite impeller, thereby minimizing the fluid return space between the tips of each impeller and the interior concave side walls of the opposite impeller. The tips of each impeller are sufficiently wide so that the exit side tip corner is maintained very close to the adjoining slightly elipsoid arc side wall during substantially all the first half of the passage past the slightly elipsoid arc side wall. Simultaneously, the inlet side tip corner is disposed a relatively great, but decreasing distance from the slightly elipsoid arc side wall, said distance being a function of the volume of fluid trapped in the fluid return space adjacent the slightly elipsoid arc side wall. At the same time, the tips of a lobe are making a close approach to the cavity formed between two adjoining lobes of the opposite impeller, as the tip approaches the cavity, one of the tips of the opposite impeller is close to the cavity formed on one side of the tip which is approaching, remains close during part of the rotational cycle, then moves apart. As the tip begins to depart from its closest approach to the cavity, the other tip adjoining the cavity comes in relatively close proximity to the surface adjoining the tip departing from the cavity. Accordingly, not only the corner of the tip, but substantially all of the side of the lobe on the side of the tip is relatively close to the side of an adjoining lobe of the opposite impeller. As each tip in turn approaches and moves away from the cavity of the opposite impeller which is in phase with it, it gradually forms, then unforms an S-shaped cross-section fluid return space first on the side of the tip closest to the fluid entrance and with the lobe of the opposite impeller which precedes it by 45°. As the preceding S-shaped cross-section return space expands, a following S-shaped cross-section return space forms on the following edge of the lobe. The flexion points of the tips come in very close proximity to surfaces of the opposing tips, thereby maintaning the S-Shaped cross-section return space in a relatively narrow configuration for a substantial part of the rotational cycle. Because the return space has an S-shaped cross-section with pinch points near the inflexion lines, and because of the narrow width of the S-shaped cross-section, very little fluid returns from the high pressure side to the low pressure side.

The S-shaped cross-section return space closes as the lobe tip approaches the other cavity with its largest opening away from the point midway between the two axes of the two impellers, and the distance between the two surfaces of the two impellers during approach and departure is a function of the distance from a line drawn between the two axes of the two impellers, so that the cross-sectional area of the opening or closing S-shaped cross-sectional return area is relatively proportional to the amount of fluid which must pass through to escape from the return area as it decreases in volume or to enter the return area as it increases in volume. These characteristics reduce turbulence in the return area, substantially reduce vibration of the pump as compared to prior art pumps, and substantially reduce the amount of fluid returned to the inlet side. This combination substantially increases pump efficiency.

Drive means such as those known to the prior art are coupled to axial shafts of the two impellers to rotate the two impellers in opposite directions, 45° out of phase so that the lobe of one impeller is exactly in phase with the cavity formed between two adjoining lobes of the opposite impeller. Bearings are used as in the prior art to reduce friction and are coupled at least to the axial shafts. Timing gear means are coupled between the drive means and the axial shafts of the two impellers to maintain the two impellers 45° out of rotational phase with each other.

Each tip may include a fluid flow spoiler to increase fluid turbulence. This increasing of fluid turbulence reduces backflow past the ends of the tips and between the tips and the at least 180° arc cross-section adjoining interior wall, also referred to as the interior wall. The turbulence increases sealing properties between each tip and the interior wall. The spoiler comprises a semi-circle cross-section indentation having a diameter one-third the length of the arc forming the tip, centered on the tip, and extending the length of the tip.

A particular example of the invention has the following dimensions and orientations. The pump diameter is 3.02 inches from tip to opposite tip. Each tip arc is 0.342 inches wide. The lobe outer side walls form arcs of approximately 57°, the center point of the arcs being disposed 0.885 inches from a vertical line passing through the center of the impeller and 0.608 inches from a line perpendicular to the first line, passing through the center, and passing equidistant between two lobes.

Perhaps the closest prior art to the present application is U.S. Pat. No. 4,057,375 issued Nov. 8, 1977 to the present applicant.

During approximately half the rotational cycle, the space between the two impellers comprises a relatively narrow S-shaped cross-section volume with three choke points. During the other approximately half of the cycle, when the tip of one impeller is closest to the center of the opposite impeller, the space between the two impellers comprises a relatively narrow C-shaped cross-section volume which includes at least two choke points.

DRAWING DESCRIPTION

Reference should be made at this time to the following detailed description which should be read in conjunction with the following drawings, of which:

FIG. 1 is a cross-sectional diagram of a pump according to the present invention with the trailing edge of the left lobe of the right impeller making its closest approach to the leading edge of the bottom right lobe of the left impeller;

FIG. 2 is a cross-section of the pump illustrated in FIG. 1 with the leading edge of the left lobe of the right impeller making its closest approach to the trailing edge of the top right lobe of the left impeller;

FIG. 3 is a larger diagram of one lobe and the adjacent interior surface of an impeller illustrating certain dimensions of the tip and interior surface of the impeller;

FIG. 4 is a partially cut away partial block diagram of the invention of FIG. 1 along the line 4—4;

DETAILED DESCRIPTION

Figure 5:
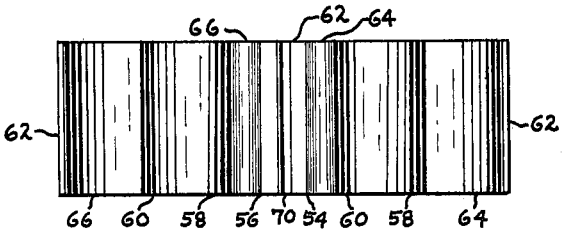
FIG. 5 is a side view of an impeller as shown in FIG. 1.
Figure 6:
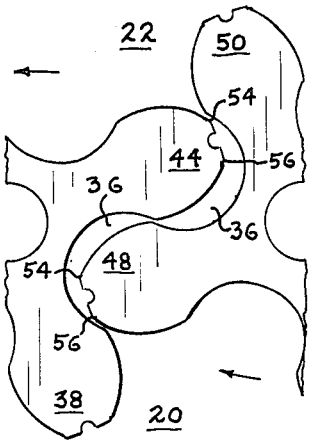
FIG. 6 is another diagram of the intermeshing of the tip of one lobe with the space between the two opposing lobes.
Figure 7:
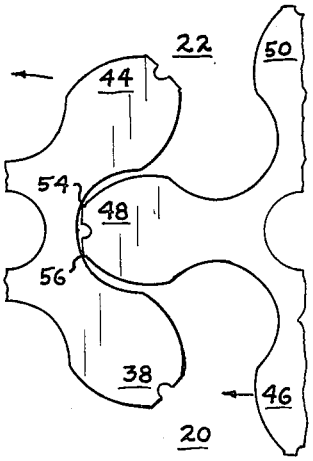
FIG. 7 is another diagram of the intermeshing of the tip of one lobe with the space between the two opposing lobes.
Figure 8:
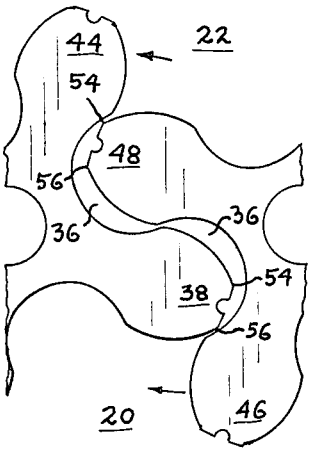
FIG. 8 is another diagram of the intermeshing of the tip of one lobe with the space between the two opposing lobes.
Figure 9:
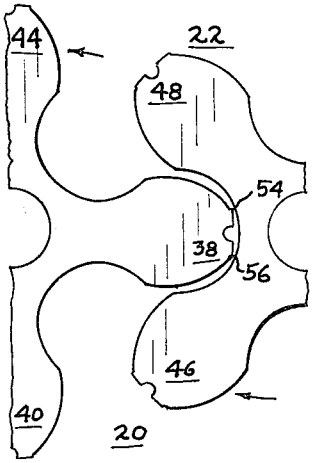
FIG. 9 is another diagram of the intermeshing of the tip of one lobe with the space between the two opposing lobes.

Reference should be made at this time to FIGS. 1 and 2 which show the cross-section of a pump 10 according to the present invention. The pump 10 comprises impellers 14, 16 within a housing 12. The impellers 14, 16 each comprise four lobes, 38,40, 42, 44 and 46, 48, 50, 52 disposed 90° apart. Each impeller 14, 16 is identical to the opposite impeller, and axially symmetric and disposed about an axial hub 30, 32. The impeller 14, 16 are maintained 45° out of phase so that the lobe tip of one impeller 14, 16 is substantially in phase with the lobe interior side walls 58, 60 of the opposite impeller 16, 14. A two-impeller 14, 16 pump 10 according to the present invention is housed in a symmetrical cylindrical impeller housing 12 having at opposite sides approximately 190° arc cross-section interior walls 68 separated by a fluid inlet area 18 or fluid entrance 18 on one side of the housing 12 and a fluid outlet area 20 or fluid exit 20 on the opposite or other side of the housing 12. Since the symmetrical housing 12 comprises two 190° arcs, approximately, 68 separated by the fluid entrance 18 and fluid exit 20, the housing 12 has a generally elliptical cross-section.

The two cylindrical axially symmetric four-lobed impellers 14, 16 each have a cross-section comprising four interior concave slightly elipsoid arc side walls divided into a lobe interior side wall 58 and a lobed interior sidewall 60. Elipsoid, as used herein, means the part of the wall 58 farthest from the hub 30, 32 of the impeller 14, 16 forms an arc having a radius identical to the radius formed by the identical portion of the opposite part of the interior side wall 60. The centers of the two arc are disposed apart approximately 1/10 of their radius away from each other, so that each sidewall is fabricated in part of a cross-sectional arc approximately 66½°. The overlapping portion of the two arcs, is approximately 47°, is further machined away so that the arcs of the sidewalls 58, 60 phase into each other in one smooth curve which follows a path slightly farther from the centers of the two arcs of the sides 66, 64, than the radius thereof, and increases slightly in length from the radius as a function of its nearness to the midpoint between the sidewall segments 64, 66. Approximately 66½° from the beginning of the elipsoid curve, each sidewall 64, 66 reaches a flex point where the side surface of the lobe 38–52 form a convex arc cross-section surface of radius approximately 80° of the greatest width of the impeller lobe and approximately 57° of arc. The surfaces are referred to as the lobe leading edge 54 and lobe trailing edge 56. The ends of the leading edge 54 and trailing edge 56 are coupled to the tip 62 which comprises two side surfaces disposed along the radii of the impeller 14, 16 and approximately 1 percent of the diameter of the impeller 14, 16 farther from the center of the impeller than the end of the convex curve, 64, or 66.

Each impeller 14, 16 is 45° out of rotational phase with the other or opposite impeller 16, 14 and each impeller is coaxial to the axis of the 190° arc cross-section interior wall 68 to which it is adjacent. Each impeller 14, 16 has a radius incrementally less than the radius of the adjoining interior wall 68. By incrementally is meant initially perhaps 0.005 of an inch. After the pump is in operation, there is a tendency for materials such as salt dissolved in the fluid being pumped to deposit on the tips 62 and the housing interior surfaces 68 adjacent to the tips. This deposit will be worn away by passage of the tips 62 past the housing interior surfaces 68 until an ideal amount of deposit is formed. Thereafter as more deposits form it is worn off and the minimum practicable distance is maintained between the tips 62 and the housing interior surfaces 68, which is defined as an increment.

The impellers 14, 16 are disposed apart sufficiently so that the tips of each impeller 14, 16 fail by only an increment to touch the interior concave arc sidewalls 60, 58 of the opposite impeller 16, 14. The tips 62 also pass relatively close to the lobe leading edge and trailing edge 64, 66 of the opposite impeller 16, 14. Here again, materials such as salt will deposit on the sides of the lobes 54–60 and will be worn off to maintain the closest, most efficient, tightest fit which will in turn minimize the back flow of fluid from the fluid exit side 20 to the fluid entrance side 18 through a fluid return space 36 of variable size which forms between the tip 62 and the adjoining portions of that lobe and the interior surfaces 58, 60 between the two adjacent lobes which form a cavity 59 which meets with the tip 62 of the associated lobe of the opposite impeller 16, 14.

The space 36 formed by the cavity 59 of one impeller 14 and the tip 62 of the opposite impeller 16 is never cut off from fluid communication with the fluid inlet space 22 and the fluid exit space 34, but because of the close fit of the tip 62 into the space 59 at nearly all points of the arc, very little fluid flows back from the outlet space 34 to the inlet space 22.

Reference should be made at this time to FIG. 4 which illustrates a partially cut away view of the invention of FIG. 1 along the lines 4—4. A larger view of the space between the lobes is shown on FIG. 3. Drive means 72 rotate an axle 32 also known as a shaft 32 of impeller 16. Bearings 74, 76 are utilized to minimize friction for the impellers 16, 14. A timing gear 78 is driven by the drive means 72 and in turn drives timing gear 80 which in turn drives shaft 30 which drives impeller 14, thereby keeping impellers 14, 16 in phase during their rotation. The timing gears are retained in a timing gear housing 82. The pump 10 has the shape of a cylinder of selected lengths which may be practically any length known to the prior art.

A tip 62 in a first example of the invention comprise arcs of radius equal to the radius of the impellers 16, 14. In another example, dual tips 62 are utilized. The dual tips 62 are fabricated from the tips 62 by cutting out of each tip 62 a semicircular cross-section of diameter ⅓ the cross-sectional diameter of the tip 62. These cutout portions are called tip indentations 70, best shown on FIG. 3. The tip indentations 70 change the flow pattern of the fluid as the tip 62 comes into proximity with the pump chamber wall 68, thereby slightly increasing pump 10 efficiency.

A particular example of the pump 10 is 3.024 inches in diameter from tip 62 to opposite tip 62. The tips 62 are 0.342 inches wide and the semi-circular tip indentation is 0.057 inches in radius and centered at the center of each tip 62. The lobe outer sidewalls 64, 66 form arcs approximately 57°. The center point of the arc, if the impeller cross-section is rotated so that each lobe 38–52 is disposed at a 45° angle from the vertical as follows:

The center of each arc for outer sidewall 64, 66 is disposed 0.8855 inches from a vertical line passing through the center of the impeller 14, 16 and 0.6079 inches from a horizontal line passing through the center. Of course, each lobe 62 has two outer sidewall surfaces 64, 66 one of which is centered as above, and the other of which is centered the same distance from the horizontal line as the previously described distance from the vertical line and the same distance from the vertical line as the previously described distance from the horizontal line. With the impeller 14, 16 in the same orientation, the concave interior side of the lobe 58, 60, form an arc about a point 0.886 inches disposed along a radius from the center passing equidistance between the two surfaces 58, 60 and disposed approximately 0.05 inches above and below the midpoint between the two surfaces 58, 60. The impeller 16, 14 is hollow and has a hub of approximately ½ inch to permit the shaft 30, 32 to drive the impeller 14, 16.

Each tip 62 may include a fluid flow spoiler 70 also referred to as a tip indentation 70 to increase fluid turbulence in a selected manner. This increasing of fluid turbulence reduces backflow past the ends 54, 56 of the tips 62 and between the tips 62 and the at least 180° arc cross-section adjoining interior wall, also referred to as the interior wall 68 or interior surface 68. In one example of the invention, the interior walls 68 has the cross-section of an arc of 190°. The turbulence increases sealing properties between each tip 62 and the interior wall 68. The spoiler 70 may comprise a semi-circle cross-section indentation having a diameter one-third the length of the arc forming the tip 62, centered on the tip, and extending the length of each cylindrical tip 62.

The capacity of the pump 10 may be increased by lengthening the cylinders which comprise the impellers 14, 16 and the housing 12, and the length of other necessary associated elements of the present invention. Accordingly, the volume of a pump 10 according to the present invention may be substantially modified without expensive retooling costs by generating a family of different cylinder lengths using substantially the same tooling.

Each impeller 14, 16 is 45° out of rotational phase with the other impeller 16, 14. The tips 62 of each impeller 14, 16 are sufficiently wide so that the exit side tip corner 56 is maintained very close to the adjoining slightly elipsoid arc side wall 60 during substantially all the first half of the passage of the tip 62 past the elipsoid side wall 60. The elipsoid side wall 58, 60 may be fabricated by forming two cross-sectional arcs with their centers disposed slightly apart, than further removing slightly more material in the approximately 47½° of the center portion of the two combined arcs so that it resembles the slight change in curve of the surface of the longer side of an elipse.

During the part of the rotational cycle, when the tip 62 is closest to the center of the opposite impeller 14 or 16, the cross-section of the space 36 between the two impellers 14, 16 has a C-shaped cross-section with two choke points. A choke point is defined as a place where the tip or edge of one impeller closely approaches the edge or tip of the opposite impeller, thereby substantially preventing fluid flow between the two impellers for the increment of time of close approach. The C-shaped cross-section points first one way, then the other way, depending on which impeller 14, 16 has a tip 62 approaching the opposite impeller 16, 14. The C-shape opens slightly on either its top or bottom just before and just after the point of closest approach and as it opens slightly more, (one side of the C-shaped opens on tip 62 approach and the other side on tip 62 departure from closest approach to the center of the opposite impeller), a tip 62 adjacent the wall 58, 60 closely approaches a wall 58, 60 adjacent the opposite tip 62 forming a second but inverted generally C-shaped cross-section space. The combination of the two C-shaped cross-section spaces 36 forms an S-shaped cross-section return space 36 during approximately half the rotational cycle. The S-shaped cross-section volume includes three choke points in the cross-section which inhibit along the entire length of the cylinders forming the impellers 14, 16 the passage of nearly all fluid flow through the space 36 between the two impellers 14, 16. The cross-sectional space 36 between the two impellers 14, 16 include at all times at least one opening the width of which is a function of the volume of fluid passing through the opening at each increment in time. This relation between opening size and fluid flow volume substantially reduces compression of fluid in and near the return space 36, thereby reducing vibration, wear and the inefficiencies of prior art pumps 10.

A particular example of the invention has been disclosed herein. Other examples will be obvious to those still in the prior art. The invention is limited only by the following claims.

I claim:

1. A self-priming positive displacement two impeller pump, comprising:

a symmetrical generally elliptical cross-section cylindrical impeller housing having at opposite sides at least 180° arc cross-section interior walls separated by a relatively low pressure fluid inlet space coupled to a fluid entrance on the inlet side and a relatively high pressure fluid outlet space coupled to a fluid exit on the opposite exit side;

two axially parallel counter-rotating synchronously rotated cylindrical axially symmetric four lobe impellers, each impeller having a cross-section comprising four interior concave slightly elipsoid arc side walls disposed 90° apart and each elipsoid side wall forming half the base of two adjacent lobes of the four lobes, the interior arc lobe side wall connecting at an inflexion line to a convex arc cross-section tip having an arc radius equal to the impeller radius;

each impeller is 45° out of rotational phase with the other impeller and each impeller is coaxial with the axis of the at least 180° arc cross-section adjoining interior wall, has a radius incrementally less than the radius of the adjoining interior wall, such that adjacent lobes of each impeller during rotation define between themselves and the housing arc interior wall spaces which carry fluid from the fluid inlet area to the fluid outlet area, the impellers being selectively disposed apart such that the tips of each impeller fail by only an increment to touch the interior concave arc sidewall of the opposite impeller, thereby minimizing the fluid return space between the tips of each impeller and the interior concave side walls of the opposite impeller, the tips being sufficiently wide so that the exit side tip corner is maintained very close to the adjoining slightly elipsoid arc side wall during substantially all the first half of the passage past the slightly elipsoid arc side wall while the inlet side tip corner is disposed a relatively great, but decreasing distance from the slightly elipsoid arc side wall, said distance being a function of the volume of fluid trapped in the fluid return space adjacent the slightly elipsoid arc side wall, and during substantially all of the second half of the passage the inlet side tip corner remains relatively close to the slightly elipsoid arc side wall while the exit side tip corner gradually increases its distance from the slightly elipsoid arc side wall, said distance being a function of the amount of fluid trapped in the fluid return space adjacent the slightly elipsoid arc side wall;

drive means coupled to axial shafts of the two impellers to rotate the two impellers in opposite directions;

bearings coupled to the axial shafts to reduce friction;

timing gear means coupled between the drive means and the axial shaft of the two impellers to maintain the two impellers 45° out of rotational phase with each other;

wherein each tip includes a fluid flow spoiler to increase fluid turbulence which reduces back flow by increasing sealing properties between the tip and the at least 180° arc cross-section adjoining interior wall; and wherein the spoiler has a semi-circle concave cross-section and a diameter one-third the length of the arc which forms the tip, and the spoiler is centered at the center of the tip.

2. The invention of claim 1, wherein the various elements and orientations of elements are approximately proportional to the following dimensions and orientations:

pump diameter is 3.02 inches from tip to opposite tip;

each tip arc is 0.342 inches wide;

the lobe outer side walls form arcs of approximately 57°, the center point of the arcs being disposed 0.885 inches from a vertical line passing through the center of the impeller and 0.608 inches from a line perpendicular to the first line, passing through the center, and passing equidistant between two lobes;

the concave interior side of two adjacent lobes forms an arc about a point 0.886 inches disposed along a radius from the center of the impeller passing equidistant between the two surfaces of the adjoining lobes and disposed approximately 0.05 inches off the midpoint between the two surfaces.

3. The invention of claim 1, wherein during approximately half the cycle, the space between the two impellers comprises a relatively narrow C-shaped cross-section volume wherein said C-shaped cross-section includes at least two choke points which inhibit the passage of nearly all fluid flow through the space between the two impellers, and where during approximately half the rotational cycle the space between the two impellers comprises a relatively narrow S-shaped cross-section volume wherein said S-shaped cross-section includes at least three choke points which inhibit the passage of nearly all fluid flow through the space between the two impellers, and where the cross-sectional space between the two impellers includes at all times at least one opening, the width of which is a function of the volume of fluid passing through the opening at each increment of time.

* * * * *